United States Patent [19]

Francis et al.

[11] 4,108,927

[45] Aug. 22, 1978

[54] METHOD OF MAKING LEAD SHOT

[76] Inventors: James A. Francis, 5 Chakola Ave., Hornsby Heights, 2077 Sydney, N.S.W., Australia; Brian G. Francis, 24 Grove St., Raunds, Northamptonshire; Frederick L. Francis, 1 Bedford Rd., Rushden, Northamptonshire, both of England

[21] Appl. No.: 686,241

[22] Filed: May 13, 1976

[30] Foreign Application Priority Data

May 13, 1975 [GB] United Kingdom ..... 20100/75

[51] Int. Cl.[2] ..... B01J 2/06

[52] U.S. Cl. ..... 264/13; 264/14; 264/15

[58] Field of Search ..... 264/13, 15, 14

[56] References Cited

U.S. PATENT DOCUMENTS

| | | | |
|---|---|---|---|
| 3,297,799 | 1/1967 | Jacklin et al. | 264/15 |
| 3,323,888 | 6/1967 | Searight et al. | 264/15 |
| 3,350,482 | 10/1967 | Bowers | 264/15 |

*Primary Examiner*—Robert F. White
*Assistant Examiner*—James R. Hall
*Attorney, Agent, or Firm*—Brisebois & Kruger

[57] ABSTRACT

Method of making lead shot by allowing droplets of molten lead to fall into a liquid quench bath and be thereby solidified. The droplets fall through a heating zone, particularly a flame of burning gas, into the quench bath. The apparatus to be used to practice the method preferably includes a container for molten lead comprising a generally V-shaped channel member having apertures in its base to permit molten lead to pass therethrough and exit as droplets.

4 Claims, 2 Drawing Figures

METHOD OF MAKING LEAD SHOT

Figure 1:
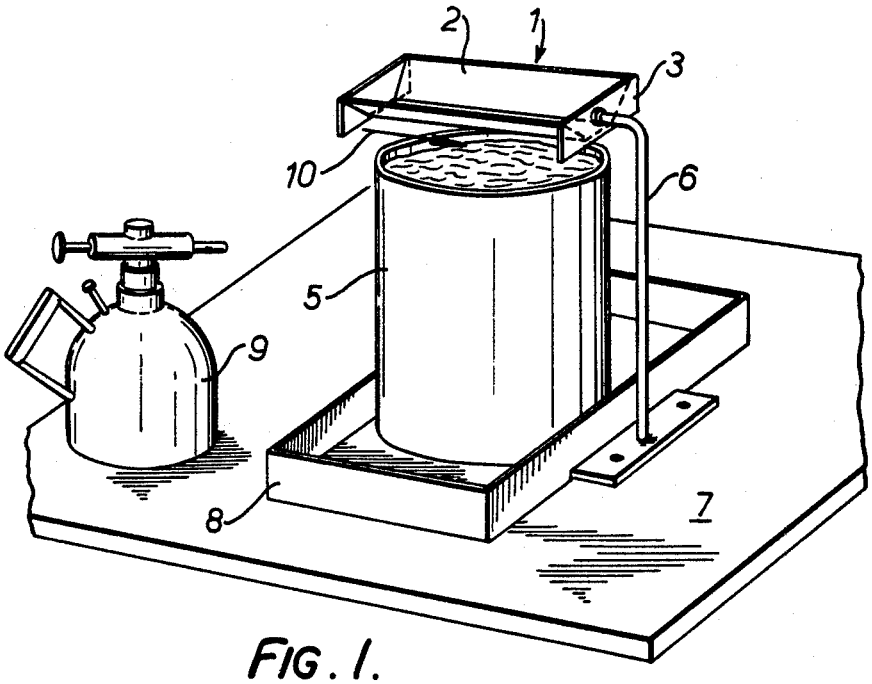

This invention is concerned with a method of making shot, particularly lead shot.

It is known to make lead shot by allowing droplets of molten lead to fall from a container into a collection vessel. During fall, the droplets assume a spherical or near-spherical shape. The collection vessel may contain a cool liquid, although normally the droplets solidify during their fall and are merely cushioned by the liquid rather than quenched. There have been many proposals in the past for improving this basic process, and of these proposals a large number have involved the use of complex and expensive apparatus, such as large towers, or the use of costly materials such as special non-aqueous fluids for cooling the shot. Other proposals have involved complicated devices for forming the droplets.

We have found that lead shot can be reliably and efficiently produced in a very simple manner. The process can be operated on any scale, from a large commercial operation to a very small operation sufficient, for example, for the requirements of only one person. The apparatus in the latter case can be very simple indeed and easily operated by one person.

According to the invention, there is provided a method of making lead shot, which comprises forming droplets of molten lead and allowing them to fall into a qunching liquid and be solidified therein, wherein the droplets pass through a heating zone before entering the quench liquid.

The invention also includes apparatus for carrying out the method, which apparatus comprises a container for molten lead, means for dispensing droplets of molten lead from the container, a collection vessel disposed vertically below said dispensing means, for containing a quenching liquid, and means disposed between the dispensing means and the collection vessel, for heating the droplets before their entry into the quenching liquid.

In the apparatus for practicing the method of the invention, the molten lead container may, in a simple form, comprise a vessel having one or more apertures in its base, through which the molten lead will run and exit as droplets. In such cases, the diameter (or size) of the apertures will affect the size of the droplets formed, the smaller the size the smaller being the droplet (and hence the shot) size. Other more complex arrangements can be used as desired.

A preferred container for use with the method of this invention, is a shot-pot which comprises a generally V-shaped channel member, the ends of the channel being closed, and the base of the channel (formed by the apex of the "V-shape") having one or more apertures formed therein.

The preferred quenching medium is water, although other media can be used. The droplets are molten when they enter the quench liquid, and are then quickly cooled to solidify the lead. To this end, the quench liquid must be cool enough to effect the desired quenching. If its temperature rises too high, the droplets will not solidify in spherical form.

The heating of the droplets is preferably effected close to their exit from the molten lead container (or other dispensing means). It is very difficult to quantify the amount of heating required, since this will depend on all (or most) of the other process parameters. However, the optimum conditions in any particular case can be found by routine trial and experiment.

The heating means can be in the form, for example, of electric radiant heaters or other electric heaters, but it is especially preferred according to the invention to use gas heaters, with the gas flame disposed across the path of the falling droplets. In this way, the droplets pass through the flame during their fall into the quench liquid. Gas heaters or flames have the advantage of ease of control and relative economy. Preferred are hydrocarbon gas torches such as propane or butane torches.

All sizes of lead shot can be produced according to the present invention. The size of the shot will depend on the size of the molten droplets, which in turn will depend on the means for producing the droplets.

Figure 2:
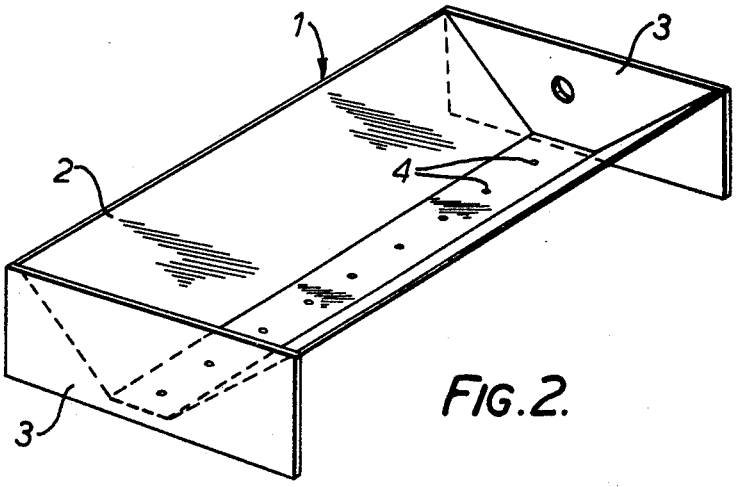

In order that the invention may be more fully understood, one embodiment thereof will now be described, by way of example only, with reference to the accompanying drawings, in which:

FIG. 1 shows an arrangement on a small scale for operating the method of the invention; and FIG. 2 shows in more detail a shot-pot for use in the arrangement of FIG. 1.

Referring to the drawings, FIGS. 1 and 2 show a shot-pot 1 which is a trough-like container for molten lead. It comprises an angle-piece of steel 2 with end walls 3. In the base are drilled (or otherwise formed) holes 4 through which the molten lead can pass.

Disposed about 2 inches below the shot-pot is a container 5 for containing the quench water (or other liquid). The shot pot is mounted on a stand 6 which in turn is fixed to a work surface 7, on which container 5 stands in a tray 8 for spillage.

In operation, molten lead is poured into the shot-pot 1, which has preferably been preheated using a gas torch 9. This may be a propane or butane torch, for example, or a paraffin blowlamp for example. The molten lead passes through holes 4 in the shot-pot and falls as droplets towards container 5. The flame of the torch 9 is directed across the path of the droplets (arrow 10), close to the under side of the shot-pot, so that all the droplets pass through the flame. The molten droplets then enter the water in container 5 and are quenched. The shot so produced can then be separated from the water and dried.

The cooler the quench liquid is, the better. Using the above described arrangement, a gallon of cold water will suffice for up to about 28lb. of shot. The water will then have warmed up, and should be cooled or replaced with fresh cold water.

In the above arrangement using hole sizes of about 1/32 inch, size 7 shot and smaller can be produced when there are about five holes in the shot-pot. With fewer holes, the shot size becomes smaller, whereas when more holes are used, the size of the shot produced will be greater. The size of the holes can of course be varied to vary the size of the shot produced.

It is possible by the method of the invention to make shot which is very close to perfectly spherical, although normally the shot will have a slight dimple effect. This is because, in the method of the invention, the length of the fall of the droplets to the quench liquid is relatively small, so that the droplet does not have time to assume perfect sphericity.

If the above described process is operated without allowing the droplets to pass through the flame, the shot produced can be tear-drop shape or no shot may be formed at all, the lead forming needles or "string".

The above described apparatus for practicing the method is suitable for small scale use. However, it can be scaled up for greater productivity, simply by enlarging (elongating) the shot pot and quench bath and providing more gas torches.

What is claimed is:

1. A method of making lead shot which comprises allowing molten lead to pass through apertures in the base of a container and fall therefrom as molten droplets into a bath of cold water disposed not more than about 2 inches vertically below the container, and solidifying the molten droplets in the cold water to form shot, wherein the droplets fall from the base of the container through a heating zone disposed between the base of the container and the said bath where the droplets are heated and assume a close to perfectly spherical shape before entering the bath, wherein the droplets are heated in the heating zone by a flame of burning gas disposed laterally across the path of the falling droplets so that the droplets pass through the flame before entering the cold water.

2. A method of making lead shot which comprises heating lead to a molten condition in a shot-pot, the shot-pot comprising a generally V-shaped channel member having a base at the apex of the "V," the channel member being closed at its ends, the said base having one or more apertures formed therein through which the molten lead is allowed to pass and exit therefrom as droplets of molten lead, and wherein the said droplets fall from said apertures through a heating zone into a bath of cold water disposed not more than about 2 inches below the said base, the droplets being heated in the said heating zone and assuming a close to perfectly spherical shape before entering the said bath, wherein the droplets are heated in the heating zone by a flame of burning gas disposed laterally across the path of the falling droplets whereby the droplets pass through the flame before entering the cold water.

3. A method of making lead shot which comprises heating lead to a molten condition in a shot pot, the shot-pot comprising a generally V-shaped channel member which is closed at its ends and has a base at the apex of the "V," there being one or more apertures formed in the base, allowing the molten lead to pass through and exit from the apertures as droplets of molten lead, and allowing the droplets exiting from the apertures to fall under gravity through a distance of not more than about 2 inches through a heating zone of burning hydrocarbon gas into a bath of cold water where the molten droplets are solidified to form lead shot, the heating of the droplets in the heating zone of burning gas causing the droplets to assume a close to perfectly spherical shape before entering the said bath.

4. A method according to claim 3, wherein the apertures through which the molten lead is allowed to pass are each of diameter about 1/32 inch.

* * * * *